United States Patent [19]

Cessou et al.

[11] 4,449,850

[45] May 22, 1984

[54] ANTIPOLLUTION DEVICE FOR RECOVERING FLUIDS LIGHTER THAN WATER ESCAPING FROM AN UNDERWATER SOURCE

[75] Inventors: Maurice Cessou; Lucien Perez, both of Communay, France

[73] Assignee: Institut Francais du Petrole, Rueil-Malmaison, France

[21] Appl. No.: 207,044

[22] Filed: Nov. 14, 1980

[30] Foreign Application Priority Data

Nov. 16, 1979 [FR] France ..... 79 28354

[51] Int. Cl.[3] ..... E02B 15/04

[52] U.S. Cl. ..... 405/60; 210/923

[58] Field of Search ..... 405/60, 63, 210; 210/923, 242.1, 242.3

[56] References Cited

U.S. PATENT DOCUMENTS

| | | | |
|---|---|---|---|
| 3,561,220 | 2/1971 | Riester | 405/60 |
| 3,599,434 | 8/1971 | Missud | 405/60 |
| 3,653,215 | 4/1972 | Crucet | 210/242.1 X |
| 3,724,662 | 4/1973 | Ortiz | 405/60 |
| 3,879,951 | 4/1975 | Mason | 405/60 |

*Primary Examiner*—David H. Corbin

*Attorney, Agent, or Firm*—Millen & White

[57] ABSTRACT

This device comprises a collector element which caps a source of escaping fluid. At least the lower part of this collector element is foldable and its wall comprises a permeable lower portion to facilitate positioning of the element over the source of polluting fluid.

10 Claims, 8 Drawing Figures

ANTIPOLLUTION DEVICE FOR RECOVERING FLUIDS LIGHTER THAN WATER ESCAPING FROM AN UNDERWATER SOURCE

BACKGROUND OF THE INVENTION

The present invention relates to an antipollution device for collecting fluids escaping from an underwater source, particularly hydrocarbons released through fractures of the water bottom, or from an underwater well, from a sunken ship, or from an underwater pipe.

More particularly, the invention makes possible reduction or even elimination of sea pollution which can result from offshore oil drilling.

The recent blowout from the IXTOC 1 oil well in the Gulf of Mexico revealed the pollution risks involved in offshore drilling operations and illustrated the necessity of using equipment for substantially reducing or eliminating the risks of such pollution until, after the blowout, the well can again be controlled (for example by drilling diverted wells and optionally by cementing).

There has already been proposed antipollution devices for an underwater oil well, comprising an element adapted to cap the wellhead for collecting the hydrocarbons escaping therefrom.

U.S. Pat. No. 3,602,299 discloses an apparatus which can be positioned over an underwater hydrocarbon source to achieve combustion of the released hydrocarbons.

U.S. Pat. No. 3,599,434 teaches enclosing an offshore drilling platform with a skirt supported by a floating ring, so as to contain the hydrocarbons which might otherwise pollute the surrounding water.

Canadian Pat. No. 1 063 367 teaches capping an underwater hydrocarbon source with a dome having a central opening through which liquid hydrocarbons rise to the water surface, and with peripheral openings through which gases can escape upwardly, thereby forming an annulus which confines liquid hydrocarbons, thus facilitating their combustion.

In the publication *Offshore,* vol. 17, October 1977, No. 11, Tulsa (USA) there is disclosed a device comprising a collector element adapted for capping an underwater apparatus from which hydrocarbons escape.

U.S. Pat. No. 3,745,773 describes a drilling and production platform comprising at its lower part a hydrocarbon collecting element, this element being connected to collecting means at the top of the platform.

French Pat. No. 2,062,092 describes a floating flare comprising a vertical pipe having a permeable wall, this pipe connecting a hydrocarbon collecting element located on the water bottom to the water surface.

U.S. Pat. No. 3,548,605 describes a device for controlling a gas leakage at the level of the water bottom. This device comprises a collector element connected to the water surface by an extensible pipe which is initially folded against the collector element when this element is lowered to the water bottom.

U.S. Pat. No. 3,653,215 describes a system for containing an underwater hydrocarbon leak. This system comprises a collector element having a flexible skirt which can be folded or unfolded from the water surface by means of cables, and which comprises, at its upper part, means for recovering the collected gas and liquid.

It is however, difficult to place and hold these prior art devices in position over a source of fluids escaping under pressure, such as a blown well, due to the turbulences produced by the hydrocarbon jet escaping from the well (i.e., the zone of turbulence above this well) and to the overpressures generated when suddenly capping the blown well.

SUMMARY OF THE INVENTION

The present invention solves this problem by providing an improved device which comprises a collector element adapted to cap the underwater source of polluting products and connected to collecting means located above said collector element, with at least the lower part of said collector element being flexible and foldable and associated with handling means adapted for unfolding the collector element for placing the device into position. In order to facilitate the operation of the collector element in spite of the turbulences, the wall of the collector element comprises a permeable portion at its lower part.

BRIEF DESCRIPTION OF THE DRAWINGS

Various embodiments of the invention, of a non-limiting nature, are illustrated by the accompanying drawings, wherein.

DETAILED DISCUSSION OF THE INVENTION

The same references have been used throughout the different drawings to designate similar elements.

Figure 1:
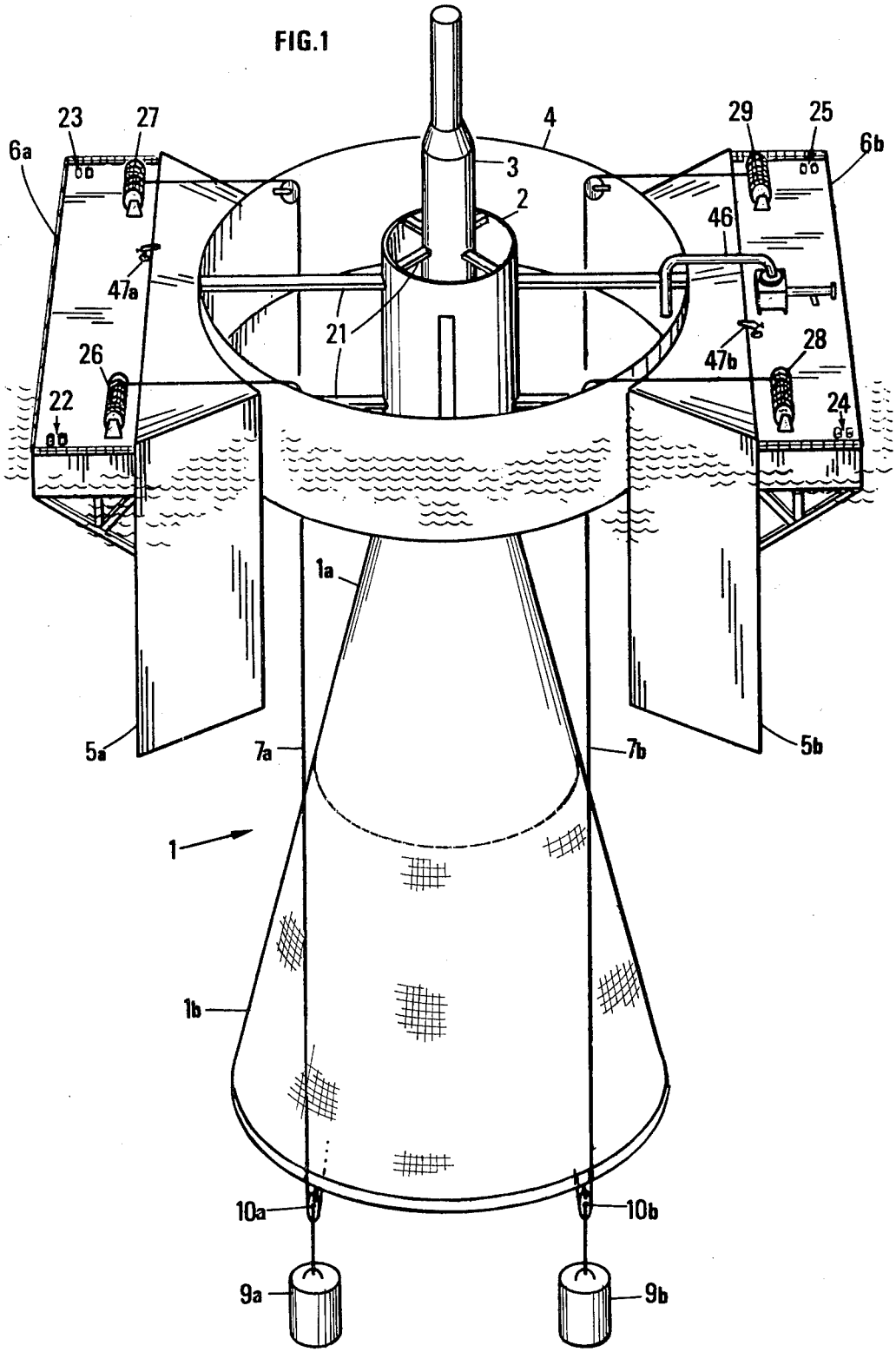
FIG. 1 is an perspective view of a device according to the invention.
Figure 2:
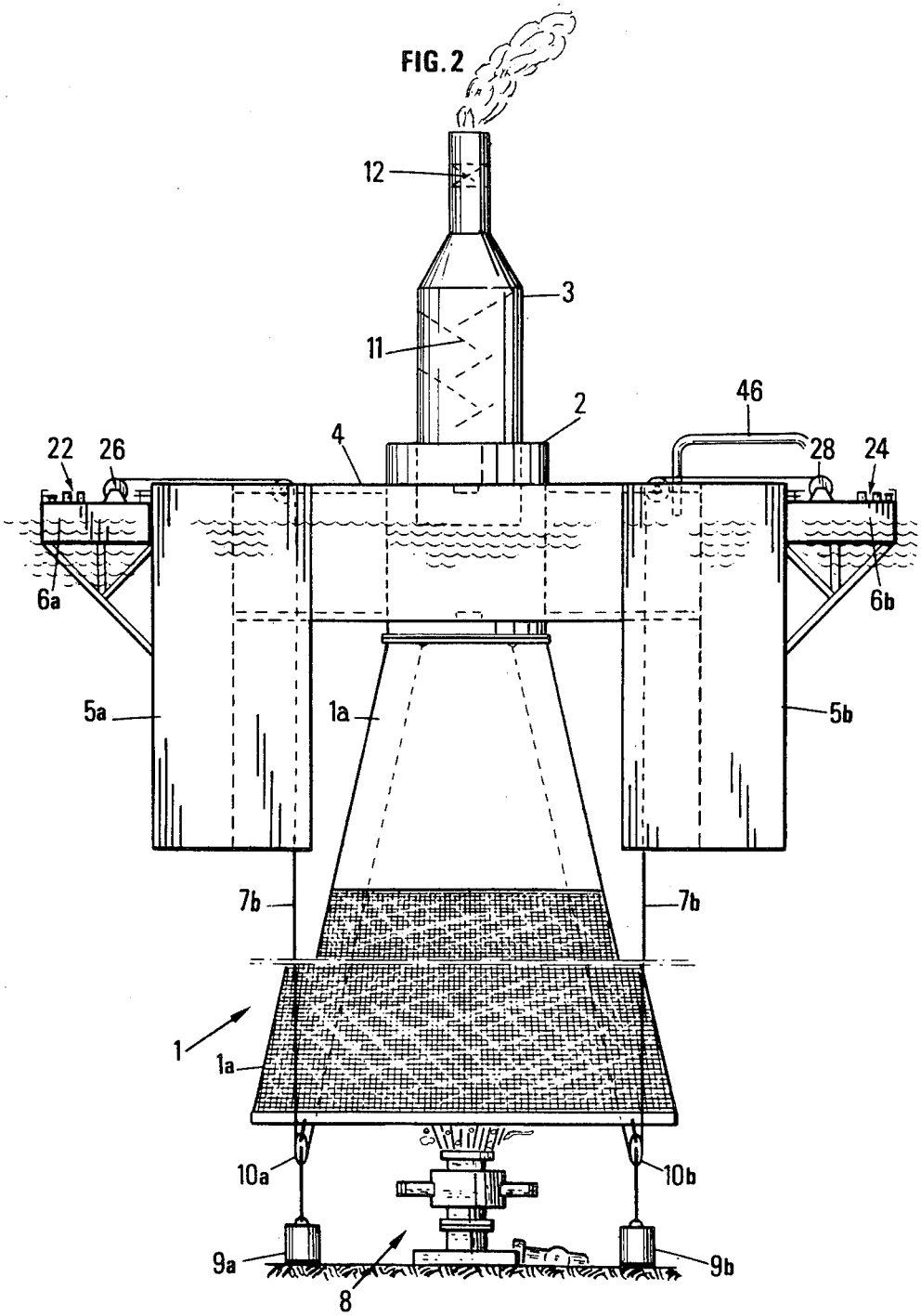
FIG. 2 is a front view of this device in its operating position.

The device for recovering hydrocarbons from an underwater blowing well which is illustrated in FIGS. 1 and 2 and comprises the following elements:

(a) a collector element 1 for collecting the liquid and gaseous hydrocarbons, this element having the shape of an inverted funnel and being weighted, (b) means for collecting the hydrocarbons, comprising a gas-liquid separation section, (c) a stack 3 with a flare, (d) an annular tank or oil recovery tank 4, (e) an assembly of two ballasts **5*a* and 5*b*, and (f) a deflagration-proof platform equipped with winches and formed of two barges 6*a* and 6*b***.

The funnel-shaped element 1 comprises a flexible conical skirt weighted at its bottom and which can be folded or unfolded by means of pull back cables **7*a* and 7*b*. The upper part 1*a* of the skirt may be made of flexible plastic material or of fabrics coated with an elastomer resistant to hydrocarbons, or alternatively of a flexible fire-proof material (for example asbestos fabric, mineral wool, glass wool, etc.). The lower part 1*b*** is made of a meshed net, for example of a metal net, providing for:

(a) a reduction of the resistance to water currents,
(b) a decrease in the turbulences caused by the blow-out,
(c) easier folding into the transportation position.

Optionally, the upper part of the funnel-shaped element may be internally lined with a frustro-conical wall of a fire-proof material whereon the skirt can be folded, this wall being itself optionally coated with a fire-proof material.

The respective proportions of the watertight part and the permeable part depends on the splaying angle of the oil and gas jet at the outlet of the wellhead 8.

The weighting means may consist of pig-iron weights 9*a* and 9*b* secured to the pulleys 10*a* and 10*b* of the pull-back cable and which, in the working position, will rest on the water bottom or remain at an intermediate depth, according to the water depth and the splaying angle of the hydrocarbon jet escaping from the wellhead.

The skirt can be reinforced by longitudinal, circular, or helical, stiffening members, or can also be made of an armouring formed of horizontal or vertical strips of high resistance to traction, such armouring being coated with a watertight film in the upper part of the skirt which must be watertight, and remaining uncoated in the lower part of the skirt which must be permeable.

The funnel-shaped element 1 may, for example, have the following dimensions:

(a) Diameter at the bottom, depending on the diameter of the bubbling zone: 30 meters or more.
(b) Diameter at the top: 5 meters.
(c) Height: depends on the water depth, for example 40 to 45 meters in the case of a well located at 50 m depth.

The section 2 of gas-liquid separation, which is positioned at the top of the funnel-shaped element, is adapted to separate the liquid (oil and entrained water) which flows into the annular tank 4, and the gas which is discharged through the stack 3.

The section 2 is made up of a circular tank (for example 5 meter diameter), and may internally comprise stationary or mobile elements (plates, baffles, blades), such as those used in low pressure vertical separators. The so-separated liquid flows over into the annular tank 4 which is coaxial to section 2.

The circular stack 3, whose diameter is slightly smaller than that of the separating section 2 (for example 4 meters), is concentric thereto. In the embodiment illustrated in FIG. 2, its lower edge position is slightly below the upper edge of the gas-liquid separating section 2, so as to contitute a liquid seal preventing any gas flow (liquid joint gasometer system).

The stack 3 is provided internally with inclinded baffle-plates 11 for the recovery of the liquid droplets carried along with the gas, and includes a flare equipped with a fire-breaking device 12 surmounted thereon.

Figure 2A:
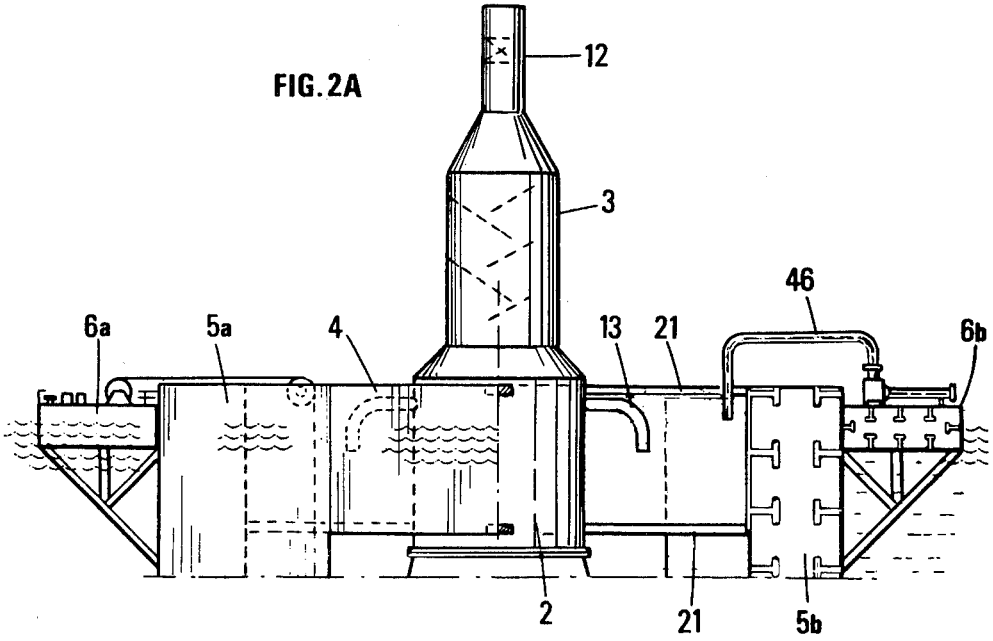
FIGS. 2A, 2B and 2C illustrate respective, in partly axial cross-section, three different embodiments of the means for collecting and separating the hydrocarbons in accordance with the invention.

The liquid joint gasometer system wherein the stack is located within the separation section may be replaced by either:

(a) a system whose separation section 2 is provided at its upper part with side pipes 13 which dip into the recovery tank and through which the liquid phase flows, the stack 3 through which the gas escapes overtopping the separating section (FIG. 2A), or
(b) a system wherein the funnel-shaped element 1 is over-topped by a collecting chamber 2*a* provided with a vertical duct 3*a* equipped with a remotely controlled valve 14, and with a lateral duct 15 connected to a vertical conventional low pressure gas-liquid separator 16 located in the recovery tank 4.

Figure 2B:
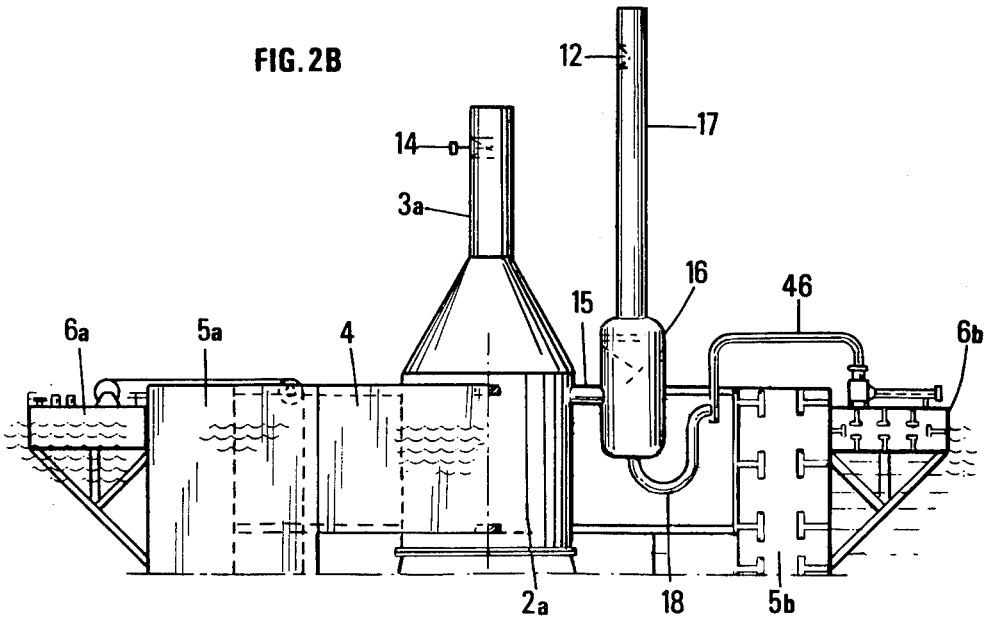

In the latter case (b) the remotely controlled valve 14 is open during the positioning of the funnel-shaped element 1 and the gas-liquid mixture escapes at the top of the duct 3*a*. Then, when the platform made up of the barges 6*a* and 6*b* is in the desired position, and the funnel-shaped element 1 has been lowered, the remotely controlled valve 14 is progressively closed, so as to direct the gas-liquid mixture towards the separator 16. The vapour phase escapes at the top of the separator towards a flare 17, and the liquid phase flows into the recovery tank through a siphon 18 (FIG. 2B).

Figure 2C:
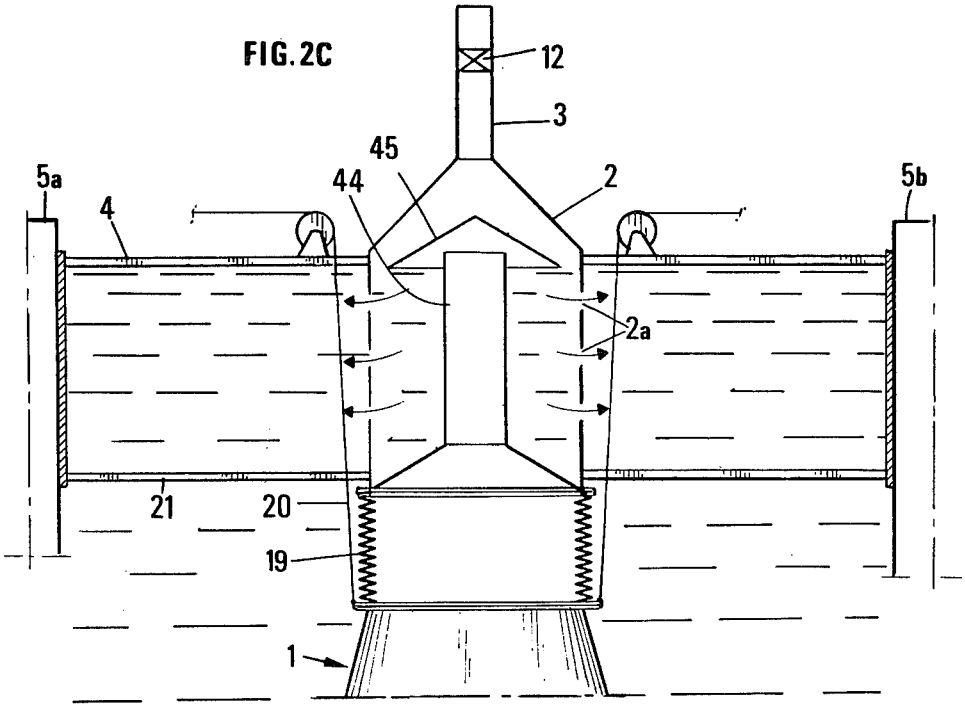

FIG. 2C illustrates another embodiment wherein the separation section 2 is provided with apertures 2*a* located below the liquid level in the annular oil-recovery tank 4. The gas escapes through a central stack 44 overtopped by a conical deflector 45, and flows into the stack 3.

In any of the selected embodiments the separation section 2 may be connected to the funnel-shaped element 1 through an extensible pipe, such as the pipe 19 shown in FIG. 2C.

This pipe 19 may be made of a fireproof material (for example, asbestos fabric, mineral wool, glass wool, etc.).

Handling cables 20 will permit unfolding of this pipe, from a folded position used to facilitate the transportation thereof.

Such an embodiment will permit use of the device according to the invention at greater depths.

The choice between these different embodiments of the assembly formed by the separation section 2 and the stack 3 will be based on observations effected during preliminary tests.

The purpose of the oil-recovery tank is to collect oil and water flowing from the gas-liquid separation section 2 and to achieve settling of oil and water so as to prevent any pollution. This tank also serves as a buffer tank from which the collected oil may be transferred into a tanker ship by pumping through a fire-breaking tank, using pumping means which are designated as a whole by reference 46.

This circular tank 4 has a diameter slightly greater than that of the bottom of the funnel-shaped element 1 (for example 35 meters), and a height comprised between 5 and 10 meters, thus resulting in a storage capacity of:

4700 $m^3$ for a height of 5 m
9400 $m^3$ for a height of 10 m.

Such capacities are sufficient to collect the daily leak flow rate from a blown underwater oil well.

The circular tank 4 is bottomless thus permitting discharge of the decanted water at its lower part and its height above the water level is adjusted by ballasting, so as to permit complete filling thereof with the collected hydrocarbons.

As a matter of fact, the equality between the hydrostatic pressures at the bottom of the tank in the oil phase and in the surrounding water, when the tank is filled up with oil, results in the following relationship:

$$h_1\rho_w = H\rho_o$$

hence $$h/H = (\rho_w - \rho_o)/\rho_w \quad (1)$$

where $\rho_w$=specific gravity of water $\rho_o$=specific gravity of oil

H being the overall vertical height of the tank 4, h the vertical draft of the tank above the water level, and $h_1$ the immersed draft of the tank 4.

For example for $\rho_o=0.9$:

$$h/H=0.1$$

i.e.:

$h=0.5$ m for $H=5$ m $h=1$ m for $H=10$ m.

The annular tank 4, the separation section 2 and the stack 3 are made integral with each other by cross-bracing members 21 (FIG. 1), optionally provided with universal joints to compensate for the action of surface swell.

Ballast means 5*a* and 5*b* partly surrounds the annular recovery tank 4 and provides for the buoyancy of the assembly, adjusting the height above the water, between:

(1) an upper position for transporting and bringing the device close to the wellhead (FIG. 3), and (2) a working position wherein the recovery tank 4 is sufficiently above the water level to enable complete filling thereof, as defined by the above-indicated relationship (1).

The lower part of the ballast means may, if necessary, be equipped with stabilizing devices (not shown in the drawings), such as those existing on semi-submersible platforms.

Two barges 6*a* and 6*b*, i.e., pontoons are placed side by side with the two ballasts, so as to form therewith a recovery platform on which are located:

(a) winches as well as guiding and breaking means 22 to 25 for cables, used for bringing the ballast means to the working site and positioning them over the well, (b) devices for filling and for emptying the ballast means 5*a* and 5*b*, (c) four constant tension winches 26 to 29 (this number being not limitative), and pulleys whereby the skirt can be progressively lowered so as to cap the well, (d) optionally constant tension winches for anchoring the platform, and (e) devices 47*a* and 47*b* for spraying water and foam, of a type used for fighting against fire.

It is advisable that all these equipments be remotely controlled, so that human presence on the platform is unnecessary, at least at the beginning of the operation. All the control devices will be pneumatic or hydraulic for obvious safety purposes.

POSITIONING AND OPERATION OF THE DEVICE

One of the most critical steps in the use of the recovery device is its positioning over the blowing well The following procedure may be followed:

1. Conveying and bringing the device to the site

Figure 3:
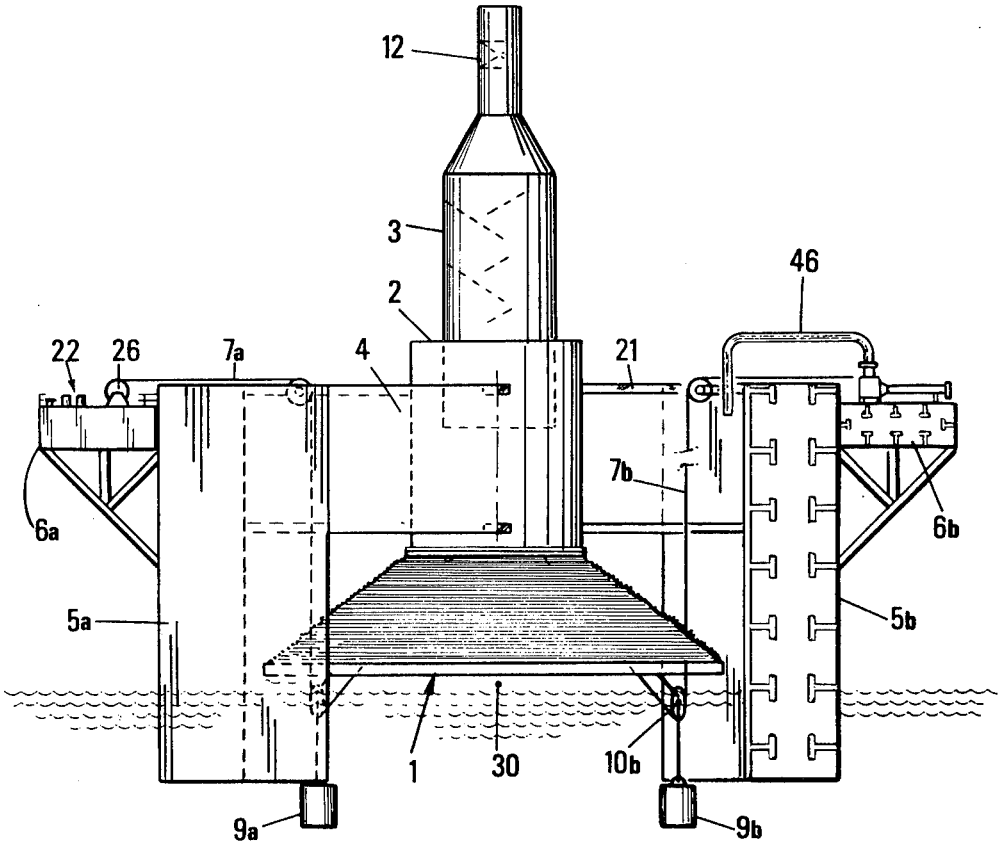
FIG. 3 shows, partly in axial cross-section, the device of FIG. 2 in position for being transported on the water surface.

For the transportation step, the barges 6*a* and 6*b* are placed in the position shown in FIG. 3: the ballasts 5*a* and 5*b* are in their upper position, the funnel-shaped element 1 is upwardly folded, its lower level 30 being above the sea level, or slightly submerged and the pig iron weights 9*a* and 9*b* in their raised position.

Figure 4:
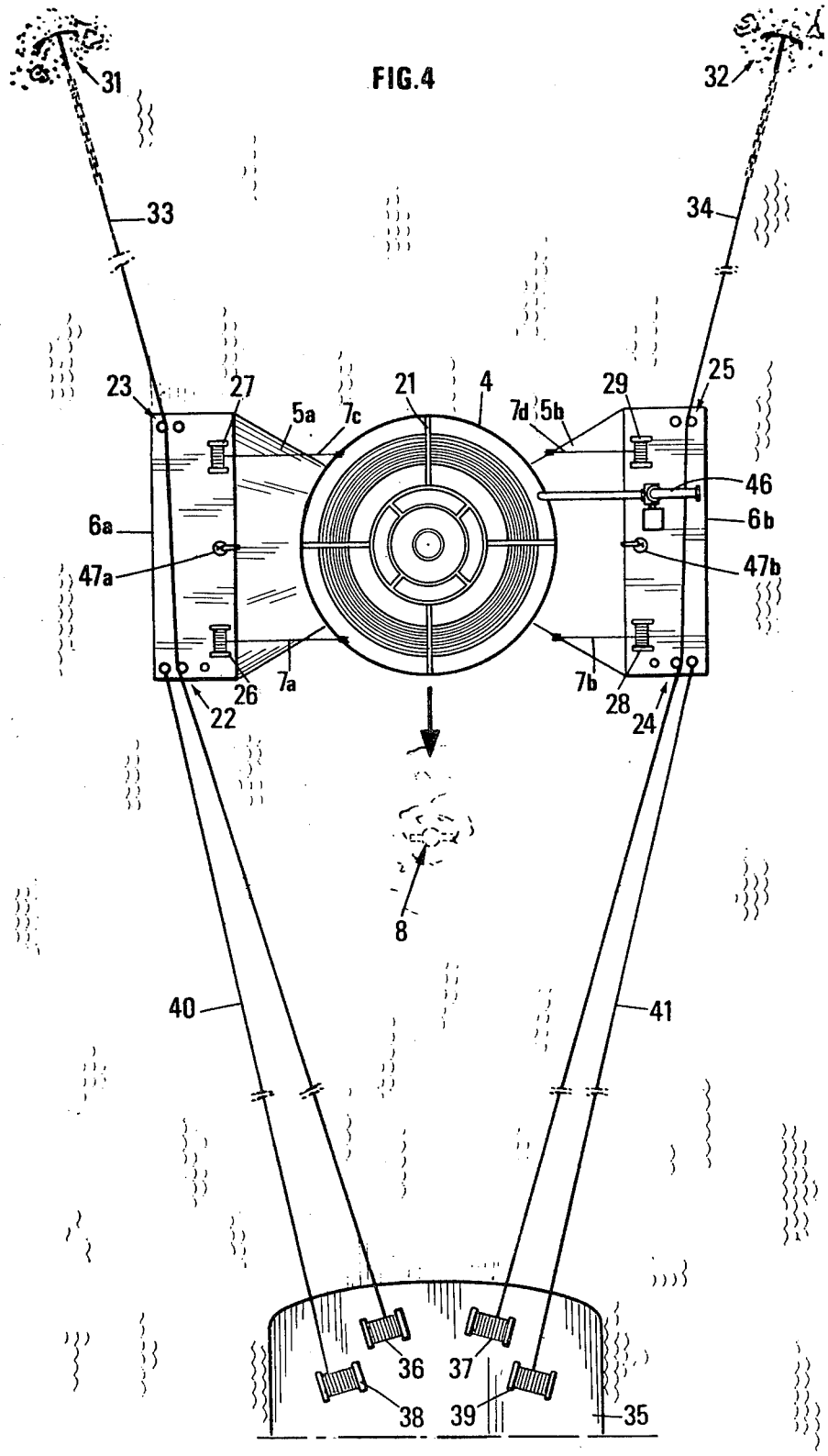
FIG. 4 illustrates a method of operation for bringing the device of the invention to the working site and for positioning thereof.

The assembly is towed to the vicinity of the well. On both sides of the platform are moored two anchors 31 and 32 (FIG. 4). Two cables 33 and 34 which will be used as guidelines connect these anchors 30 and 31 (through guiding means 22 to 25 of the platform) to a barge 35 provided with constant tension winches 36 and 37 and this barge is anchored in a position symmetrical to that of the recovery device with respect to the well. By actuating winches 38 and 39 pulling two other cables 40 and 41 which connect the recovery platform to the barge 35 the platform is progressively brought to a position vertically above the wellhead 8.

The particular structure of the funnel-shaped element 1 and the fact that the ballast means 5*a* and 5*b* do not completely surround the recovery tank 4 permit that all or part of the gas escapes laterally during the entire positioning step.

The recovery platform may then be held in position by anchoring.

2. Placing in operation

The device having been positioned above the wellhead 8, the ballast chambers 5*a* and 5*b* are progressively filled up so as to sink or submerge the assembly down to a buoyancy level which corresponds to its operating position. Since the lower part of the funnel-shaped element 1 (which is always in its folded position) is of a diameter slightly smaller than that of the recovery tank 4, all or part of the gas may freely flow along the sides of this element and oil starts to gather in the tank 4. Thus, high overpressures and turbulences are avoided which might otherwise occur if the well was suddenly capped.

The pig-iron weights 9*a* and 9*b* are then progressively lowered which, through the intermediary of the pull-back cables, causes unfolding of the funnel-shaped element 1 until the pig iron weights rest on the water bottom, or are positioned at an intermediate depth (it is optionally possible to first lower the pig-iron weights, then the weighted funnel-shaped element 1 along the so-formed guiding lines, but this would result in unnecessary multiplication of the cables and winches.

The fact that the lower portion 1*b* of the funnel-shaped element 1 is permeable greatly facilitates its positioning in the zone of turbulence.

When the watertight upper part 1*a* of the funnel-shaped element has fully capped the "plume" of the well, the device will be placed in operation, i.e. the gas will escape through the stack 3 to the flare where it will be ignited, and the oil-water mixture will flow over the separation section 2 into the recovery tank 4.

During all the steps of approaching and putting the device into operation, the assembly will be permanently wetted with water or foam.

Figure 5:
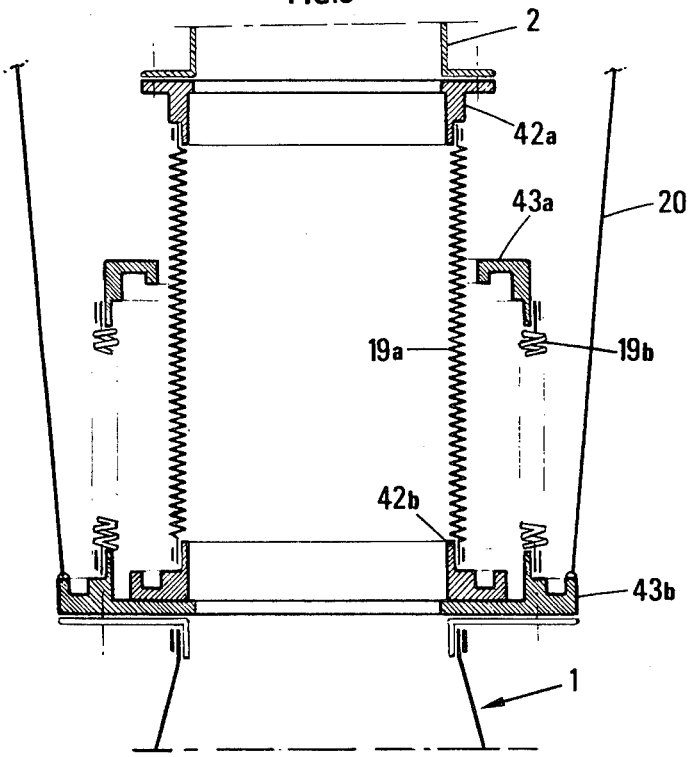
FIG. 5 is an embodiment of a flexible telescopic hose connecting the upper part of the funnel-shaped element to the means for collecting and separating the hydrocarbons.

FIG. 5 diagrammatically illustrates an alternative embodiment of the invention according to FIG. 2C, wherein a flexible extension hose 19 is made of at least two pleated elements or sleeves of a fireproof material 19*a*, 19*b* . . . having mouthpieces threaded on flanges 42*a*, 42*b*, 43*a* and 43*b*, so as to form a telescoping assembly.

This expansible extension hose 19 may be optionally internally lined over a part of its length with a sleeve made of a fireproof material, for example, a metal sleeve which may be itself internally coated with a refractory material.

What is claimed is:

1. An antipollution device for recovering fluids lighter than water, escaping from an underwater source (8), comprising:

(a) a collector element (1) adapted for capping said source (8) for trapping the fluids escaping therefrom, said collecting element (1) comprising a lower part (1*b*) and an upper part (1*a*) with at least said lower part (1*b*) being flexible and foldable, and the wall of said lower part (1*b*) being permeable;

(b) collecting means (2, 2*a*) connected to said collector element (1) and positioned above said collector element (1) for collecting escaping fluids trapped by said collector element (1), said collecting means comprising a recovery chamber (2, 2*a*) located above said collector element (1), said recovery chamber (2, 2*a*) being connected to said collector element (1), and operatively associated with gas-liquid separation means (3,16) for separating said collected escaping fluids into a liquid phase and a gas phase;

(c) an annular tank (4) surrounding said recovery chamber (2, 2*a*) for recovering the separated liquid phase, and said annular tank (4) being open at its lower part and provided with adjustable bouyancy means (5, 5*a*) comprising two vertically extending ballast chambers (5*a*, 5*b*) defining two annular sectors diametrically located at the periphery of said annular tank (4), and secured thereto; and (d) handling means (7*a*, 7*b*) operatively connected to said lower part (1*b*) for unfolding said lower part (1*b*) from a folded position at the water surface during positioning of said collector element (1) over a source of escaping fluid.

2. An antipollution device according to claim 1, wherein said two ballast chambers (5*a*, 5*b*) are of such capacity as to be capable of supporting above the water level and the assembly of said recovery chamber (2), said annular tank (4), and said collector element folded under said chamber in a position facilitating its transport to the working site.

3. An antipollution device according to claim 1, wherein said handling means comprises weight means (9*a*, 9*b*) co-operating with the lower part of said collector element (1), and cable means (7*a*, 7*b*) passing over lower direction reversing means (10*a*, 10*b*) secured to the lower edge of said collector element (1), said cable means (7*a*, 7*b*) running upwardly along said ballast chambers (5*a*, 5*b*) up to upper direction reversing means and winches (26, 28) arranged at the upper part of the device.

4. A device according to claim 1, further comprising a stack (3) for discharging gases surmounted on said chamber (2), and opening thereinto by means of at least one aperture located under the level of the upper edge of said chamber (2), so as to form in said chamber a liquid seal preventing any gas flow through said chamber.

5. A device according to claim 1, wherein the upper part of said chamber (2) is in direct communication with a gas-discharge stack (3), and wherein said chamber (2) is provided with lateral pipes (13) dipping into said annular tank (4).

6. A device according to claim 1, wherein said chamber (2*a*) is connected to a gas-liquid separation section (16) laterally located with respect to said chamber (2*a*), said separation section (16) having a gas discharge stack (17) surmounted thereon, and having, at its lower part, a siphon (18) in communication with the interior of said annular tank (4).

7. A device according to claim 5, wherein said chamber (2*a*) further comprises a by-pass conduit (3*a*) for direct discharge into the atmosphere, said conduit being equipped with a remotely controlled valve (14).

8. An antipollution device according to claim 5, wherein said gas discharge stack further comprises a flare for igniting gas flowing therethrough.

9. An antipollution device according to claim 8, wherein said gas discharge stack further comprises deflecting means for recovering liquid droplets carried along with the gas, said deflecting means positioned below said flare.

10. An antipollution device for recovering fluids lighter than water, escaping from an underwater source (8), comprising:

(a) a collector element (1) adapted for capping said source (8) for trapping the fluids escaping therefrom, said collecting element (1) comprising a lower part (1*b*) and an upper part (1*a*) with at least said lower part (1*b*) being flexible and foldable, and the wall of said lower part (1*b*) being permeable;

(b) collecting means (2 2*a*) connected to said collector element (1) and positioned above said collector element (1) for collecting escaping fluids trapped by said collector element (1), said collecting means comprising a recovery chamber (2, 2*a*) located above said collector element (1), said recovery chamber (2, 2*a*) being connected to said collector element (1);

(c) gas-liquid separation means (3,16) operatively associated with said recovery chamber (2, 2*a*) for separating said collected escaping fluids into a liquid phase and a gas phase, said gas-liquid separation means (3, 16) comprising a gas-liquid separation section (16) connected to said recovery chamber (2, 2*a*) and laterally located with respect to said recovery chamber (2, 2*a*), with said recovery chamber (2, 2*a*) being surrounded by an annular tank (4) for recovering the separated liquid phase, said annular tank (4) being open at its lower part and provided with adjustable bouyancy means (5, 5*a*);

(d) a gas discharge stack (17) surmounted on said separation section (16), and having at its lower part of siphon (18) in communication with the interior of said annular tank (4); and (e) handling means (7*a*, 7*b*) operatively connected to said lower part (1*b*) for unfolding said lower part (1*b*) from a folded position at the water surface during positioning of said collector element (1) over a source of escaping fluid.

* * * * *